United States Patent [19]

Hall

[11] Patent Number: 4,499,940

[45] Date of Patent: Feb. 19, 1985

[54] CASTING PROCESS INCLUDING MAKING AND USING AN ELASTOMERIC PATTERN

[75] Inventor: Robert T. Hall, Milford, Mich.

[73] Assignee: Williams International Corporation, Walled Lake, Mich.

[21] Appl. No.: 518,849

[22] Filed: Aug. 1, 1983

[51] Int. Cl.[3] ..... B22C 7/02; B22C 9/04

[52] U.S. Cl. ..... 164/36; 164/34; 164/35; 164/44; 164/45

[58] Field of Search ..... 164/34, 35, 36, 44, 164/45

[56] References Cited

U.S. PATENT DOCUMENTS

| | | | |
|---|---|---|---|
| 1,912,889 | 6/1933 | Couse | 164/45 X |
| 2,420,851 | 5/1947 | Zahn et al. | 164/35 |
| 3,954,132 | 5/1976 | Wheeldon et al. | 164/45 X |
| 3,982,934 | 9/1976 | Wentzell | 164/45 X |
| 4,055,213 | 10/1977 | Maher | 164/45 |
| 4,220,190 | 9/1980 | Horton et al. | 164/45 X |

*Primary Examiner*—Nicholas P. Godici
*Assistant Examiner*—J. Reed Batten, Jr.
*Attorney, Agent, or Firm*—Lyman R. Lyon

[57] ABSTRACT

A casting process for making and utilizing an elastomeric pattern that is coated with a non-metallic material to form a non-metallic shell mold and thereafter removed from the non-metallic shell mold by thermal decomposition or mechanical stripping.

10 Claims, 9 Drawing Figures

CASTING PROCESS INCLUDING MAKING AND USING AN ELASTOMERIC PATTERN

BACKGROUND OF THE INVENTION

Manufacturing processes for intricate gas turbine components, for example, wheels, nozzles, fans, compressor rotors and compressor stators are in a constant state of evolution. However, most processes have heretofore utilized rigid patterns and are therefore merely variations of the classic "lost wax" technique.

SUMMARY OF THE INVENTION

The present invention constitutes a significant advance in the art of casting intricate parts in that it teaches the substitution of a semi-flexible pattern made from an elastomer such as polyurethane for the historic rigid wax pattern.

The herein disclosed elastomeric patterns can be produced inexpensively because the plastic memory of the material permits stripping from a master mold without regard for the severe distortion incident to the stripping action. When free of the mold, the elastomeric pattern quickly assumes its original molded shape to provide a usable pattern. A pattern in accordance with the instant invention offers the additional advantage of being immune to breakage during subsequent processing steps.

In accordance with another feature of the instant invention, the elastomeric pattern can be used either as a reusable pattern, or as an expendable pattern depending on the alloy to be cast which dictates the composition and configuration of the mold. For example, a multi-stage compressor rotor casting is used in a low temperature environment and can be cast in a low temperature aluminum alloy minimizing temperature buildup in the mold. In this case the mold can be made from a relatively high strength plaster permitting the elastomeric pattern to be stripped from the plaster mold and reused.

In the case of a turbine wheel used in a high temperature environment requiring a high temperature alloy composition, the elastomeric pattern is dipped in successive coats of ceramic slurry and refractory grain until a satisfactory ceramic shell mold is built up. After drying, the ceramic shell mold is fired at a relatively low temperature to cure the mold. Since such molds are relatively fragile, the pattern is removed by firing the ceramic mold to a high temperature thereby thermally decomposing the elastomer.

DETAILED DESCRIPTION OF THE PREFERRED EMBODIMENT OF THE INVENTION

Figure 1:
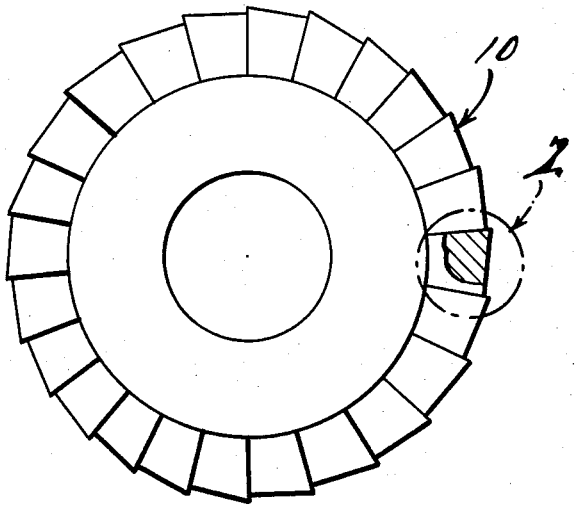
FIG. 1 is a plan view of a completed master pattern for a turbine wheel.

As seen in FIG. 1 of the drawing, the initial step in the process of the instant invention is to construct a master pattern 10 of the desired part from a metal that machines easily, is electrically conductive and can be chemically dissolved, for example, aluminum.

Figure 2:
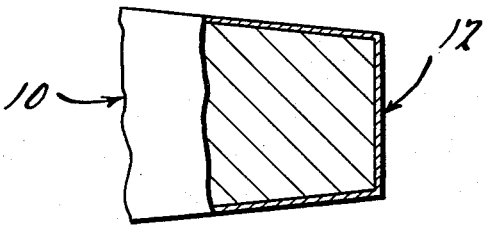
FIG. 2 is a view of the portion of the turbine wheel of FIG. 1 within the circle "2" after nickel plating.

As seen in FIG. 2, the master pattern 10 is plated with a layer of nickel 12 on the external surfaces thereof.

Figure 3:
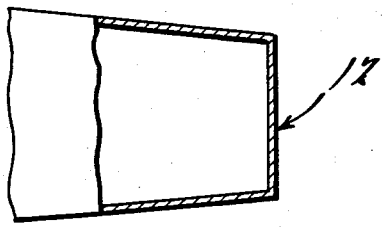
FIG. 3 is a view of a mold of FIG. 2 after the master pattern is chemically dissolved.

As seen in FIG. 3, the master pattern 10 has been chemically dissolved leaving a nickel shell 12. If the master pattern 10 is aluminum, it can be removed by immersion in a solution of sodium hydroxide which has no significant effect on the nickel shell 12.

Figure 4:
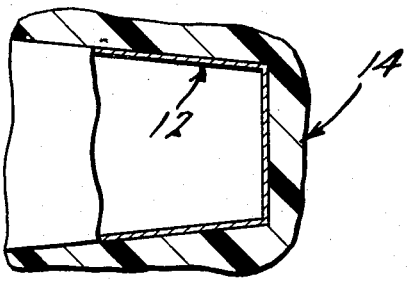
FIG. 4 is a view of the mold of FIG. 3 after "back up" by a plastic material.

As seen in FIG. 4, the nickel shell 12 is given a "back-up" structure 14 of castable, strong, thermally conductive plastic such as filled epoxy. In this manner a mold for the desired part is created, suitable for injection, transfer or compression molding of an elastomeric compound therein.

Figure 5:
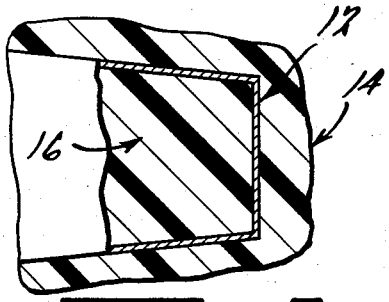
FIG. 5 is a view of the mold of FIG. 4 with a suitable elastomeric compound cast therein.
Figure 6:
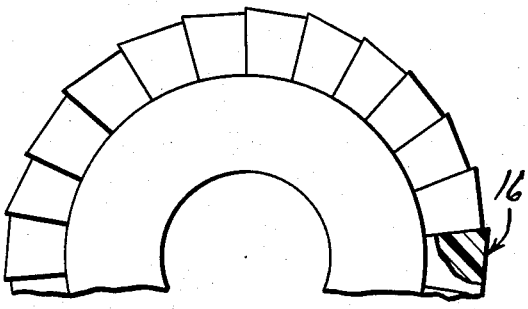
FIG. 6 is a view of the completed elastomeric pattern.

As seen in FIG. 5, an elastomeric compound is molded into the nickel shell mold 12 to form an elastomeric pattern 16. Thereafter, the elastomeric pattern 16 is stripped from the mold 12. If desired, the elastomeric pattern 16 can be assembled with other plastic or wax details to provide desired casting features, plus the mold rigging details such as pouring cup, gates, risers, runners, etc.

Figure 7:
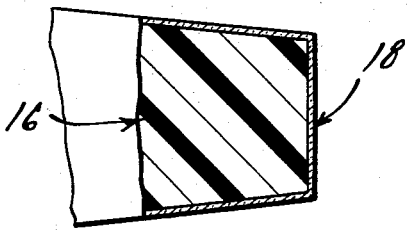
FIG. 7 is a view of the elastomeric pattern of FIG. 6 after coating with a ceramic slurry to form a shell mold.
Figure 8:
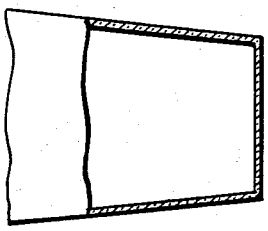
FIG. 8 is a view of the shell mold of FIG. 7 after thermal decomposition of the elastomeric pattern.
Figure 9:
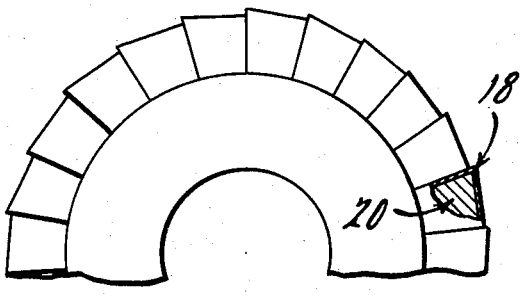
FIG. 9 is a view of the shell mold of FIG. 8 after casting of a super alloy thereinto.

As seen in FIG. 7, the elastomeric pattern 16 may be coated by dipping the pattern 16 into a ceramic slurry having refractory grains therein so as to build up a ceramic shell mold 18 around the pattern 16. After curing at a relatively low temperature, the ceramic shell mold 18 containing the elastomeric pattern 16 is placed in a high temperature furnace, at which time the elastomeric pattern 16 is thermally decomposed. For example, a room temperature castable polyurethane from CIBA-Geigy Co., Lansing Mich., sold under the tradename "REN", can be decomposed by elevating its temperature to 900–1800 F. for a period of 30 minutes.

The evacuated ceramic mold 18 is then preconditioned by preheating prior to pouring of the casting alloy thereinto in air, in a vacuum, or in a controlled atmosphere of inert gas.

The finished casting 20 is retrieved by fracturing the ceramic mold 18 by mechanical vibration, waterblasting or by dissolving the mold in molten salt. Final operations include degating of the casting and heat treatment thereof as dictated by the requirements of the alloy used.

Alternatively, the elastomeric pattern 16 may be coated with, for example, plaster and thereafter stripped from the mold for reuse.

While the preferred embodiment of the invention has been disclosed, it should be appreciated that the invention is susceptible of modification without departing from the scope of the following claims.

I claim:

1. A casting process comprising the steps of fabricating a master pattern from an electrically conductive material, plating said master pattern with a metal, chemically dissolving said master pattern to leave a metallic shell mold, reinforcing said metallic shell mold exteriorly thereof, pouring an elastomeric compound into said metallic shell mold to form an elastomeric pattern, stripping the elastomeric pattern from said metallic shell mold, coating said elastomeric pattern with a non-metallic material to form a non-metallic shell mold, removing said elastomeric pattern from said non-metallic shell mold, pouring a metal into said non-metallic shell mold to form a metallic casting, and retrieving said metallic casting from said non-metallic shell mold by destroying said non-metallic shell mold.

2. A casting process in accordance with claim 1 wherein said removing step comprises heating said non-metallic shell mold and elastomeric pattern to decompose said elastomeric pattern.

3. A casting process in accordance with claim 1 wherein said removing step comprises stripping said elastomeric pattern from said non-metallic shell mold.

4. A process in accordance with claim 1 wherein said master pattern is made from aluminum.

5. A process in accordance with claim 4 wherein said master pattern is dissolved by a sodium hydroxide solution.

6. A process in accordance with claim 1 wherein said plating metal is nickel.

7. A process in accordance with claim 1 wherein said elastomeric compound is polyurethane.

8. A process in accordance with claim 2 wherein said elastomeric pattern is heated to a temperature within the range of 900 to 1800 F. for a period of approximately 30 minutes.

9. A process in accordance with claim 1 wherein said non-metallic shell mold is made from a ceramic slurry.

10. A process in accordance with claim 1 wherein said non-metallic shell mold is made from plaster.

* * * * *